US007115224B2

(12) United States Patent
Studholme

(10) Patent No.: US 7,115,224 B2
(45) **Date of Patent: *Oct. 3, 2006**

(54) PROCESS FOR MAKING ACID DYE STAIN-RESISTANT FIBERS

(75) Inventor: Matthew Studholme, Abingdon, VA (US)

(73) Assignee: Prisma Fibers, Inc., Bristol, VA (US)

( * ) Notice: Subject to any disclaimer, the term of this patent is extended or adjusted under 35 U.S.C. 154(b) by 179 days.

This patent is subject to a terminal disclaimer.

(21) Appl. No.: 10/647,515

(22) Filed: Aug. 26, 2003

(65) Prior Publication Data

US 2004/0046279 A1 Mar. 11, 2004

Related U.S. Application Data

(62) Division of application No. 10/100,033, filed on Mar. 19, 2002, now Pat. No. 6,635,346, which is a division of application No. 09/547,795, filed on Apr. 12, 2000, now Pat. No. 6,420,044, which is a division of application No. 08/955,619, filed on Oct. 22, 1997, now Pat. No. 6,117,550.

(51) Int. Cl.
*D01F 1/02* (2006.01)
*D01F 6/60* (2006.01)

(52) U.S. Cl. ..... 264/176.1; 264/211; 525/425

(58) Field of Classification Search ..... 264/176.1, 264/211; 525/425

See application file for complete search history.

(56) References Cited

U.S. PATENT DOCUMENTS 6,537,475 B1 * 3/2003 Studholme ..... 264/172.18
6,589,466 B1 * 7/2003 Studholme ..... 264/211.12
6,680,018 B1 * 1/2004 Studholme ..... 264/172.18

* cited by examiner

*Primary Examiner*—Leo B. Tentoni
(74) *Attorney, Agent, or Firm*—Dykema Gossett PLLC

(57) ABSTRACT

Acid dye stain-resistant fibers which are formed from a polyamide composition containing a mixture of a masterbatch concentrate, a fiber-forming polyamide and a polymer, the masterbatch concentrate including a carrier and a reagent having the formula:

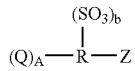

wherein Q and Z are moieties which associate with free acid dye sites in the polyamide, a is an integer from 0 to 2, b is an integer from 1 to 4, and R is an alphatic, aromatic or alicydic hydrocarbyl group. The carrier can be a terpolymer, a semi-crystallic thermoplastic polyester or plyamide having a melting point of about 235° C. or less, or mixtures thereof.

30 Claims, No Drawings

PROCESS FOR MAKING ACID DYE STAIN-RESISTANT FIBERS

BACKGROUND OF THE INVENTION

This application is a divisional of application Ser. No. 10/100,033, filed Mar. 19, 2002, now U.S. Pat. No. 6,635,346, which was a divisional of application Ser. No. 09/547,795, filed Apr. 12, 2000, now U.S. Pat. No. 6,420,044, which was a divisional of application Ser. No. 08/955,619, filed Oct. 22, 1997, now U.S. Pat. No. 6,117,550, which was related to application Ser. No. 08/522,123, filed Aug. 31, 1995, now U.S. Pat. No. 6,537,475, the entire contents and disclosure of which is incorporated herein by reference.

FIELD OF THE INVENTION

The invention relates to stain-resistant polyamide compositions and fibers and articles of manufacture formed therefrom.

DESCRIPTION OF THE PRIOR ART

Textile and carpet yarns prepared from polyamide fibers are subject to staining by a variety of foods, drinks and many other compositions with which it comes in accidental contact. The uptake of acid dye stains from, for example, soft drinks, is a particularly vexing problem for polyamide fibers due to the availability therein of acid dye sites such as amine end groups and amide linkages. Several methods have been suggested for enhancing the resistance of polyamide fibers to acid dye stains.

One approach is to apply a so-called "stain blocker" coating to the surfaces of polyamide fibers to prevent access to the acid dye sites therein by the acid dye staining composition. An example of such a method is illustrated by U.S. Pat. No. 5,145,487 which discloses coating the fibers with sulfonated aromatic condensates (SACs). Similar proposals are suggested in U.S. Pat. Nos. 4,680,212 and 4,780,099.

Another approach is to form the fibers from polyamides prepared by copolymerizing monomers, some of which contain sulfonate moieties. Typical of such systems are those disclosed in U.S. Pat. Nos. 3,542,743; 3,846,507; 3,898,200 and 5,108,684.

U.S. Pat. No. 4,374,641 relates to pigment concentrates made using sulfonated polymers as carrier resins including the highly sulfonated polyamides disclosed in U.S. Pat. No. 3,846,507. U.S. Pat. No. 5,236,645 represents an improvement on the invention claimed in U.S. Pat. No. 4,374,641.

Fibers are generally prepared from polyamides by melt-spinning. Sulfonate containing copolymers generally have higher melt viscosities than non-sulfonate containing copolymers for equivalent relative solution viscosities which limits the extent of polymerization which can be achieved in batch autoclave reaction vessels due to the retardation thereby of the rate of polymerization, as well as its hindrance of effective discharge of the polymerized melt from the reactor. In addition, the presence of sulfonates which have surfactant properties promotes excessive foaming during the melt polymerization process, resulting in poor agitation of the reaction mixture and non-uniformity of product.

Yarns having different depths of color require different levels of stain protection. Thus, light shaded colors show the presence of stains more than darker colors. It would be advantageous, therefore, to be able to provide different levels of stain resistance-to polyamides depending upon the ultimate yarn color without having to provide a separate polyamide feedstock for optimum formulation of each color yarn.

An additional disadvantage associated with sulfonate containing polyamide copolymers is that they are generally more difficult to dry than sulfonate-free polyamides due to the hygroscopic nature of sulfonate groups.

Polyamides that are topically coated to give stain resistance to the fiber, e.g., with SACs, have the disadvantage that the topical coating is removed during use and maintenance. Gradual removal of the coating will also occur during cleaning with water and detergents. Fibers used for carpet applications may be regularly cleaned with alkaline-based cleaning agents. SAC topical coatings are easily removed using these types of cleaning agents. The topical coating will also be gradually removed during normal wear of the fiber in its chosen application. In addition to their removal during use and maintenance, SACs generally have inferior resistance to light, oxides of nitrogen, and bleach, the latter of which is commonly used for the cleaning of industrial textiles and carpets. Also, the base color of SACs is not colorless and thus may change the shade of the color of the yarn.

In copending application Ser. No. 08/522,123 filed Aug. 31, 1995, there is disclosed an acid dye stain-resistant fiber-forming polyamide composition comprising a fiber-forming polyamide and a reagent, at least a portion of which associates with free acid dye sites in the polyamide, thereby disabling those acid dye sites in fibers formed from the composition from taking up acid dye stains.

Also disclosed therein are masterbatch concentrates for addition to a fiber-forming polyamide to form the above-described acid dye stain-resistant fiber-forming polyamide composition, the concentrate comprising a carrier material compatible with the fiber-forming polyamide, preferably a polyamide, combined with an amount of the reagent in excess of that desired in the acid dye stain-resistant fiber-forming polyamide such that addition of the concentrate to the compatible fiber-forming polyamide results in the desired level of stain resistance.

A disadvantage associated with the compositions and methods of the earlier application is that there are limitations in the amount of reagent which can be incorporated or "loaded" into the masterbatch concentrate utilizing the carrier materials disclosed, in particular, the polyamide carriers, indicated as preferred carrier materials, therein. It has been found that it is difficult, if not impossible, to achieve 20% or higher weight loadings of reagent in masterbatch concentrates using the preferred polyamide carriers. This is due to the fact that the melt viscosity of the resulting mixture is lowered significantly by these higher loadings of reagent, making it very difficult to produce and pelletize extrudates therefrom for incorporation into the fiber-forming polyamide. Moreover, the color of the masterbatch concentrates produced therefrom tend to be discolored yellow, thereby affecting the shade of the ultimately desired fiber color.

Most significantly, the melt viscosities of these higher loaded masterbatch concentrates are markedly lower than those of the fiber-forming polyamides such that when the masterbatch concentrates are diluted or incorporated in the polyamide feedstocks on-line in typical melt-spinning systems, the lowered melt viscosity of the resulting mixtures results in poor spinnability.

It is an object of the present invention to provide improved masterbatch concentrates containing stain-resist imparting reagents for incorporation in fiber-forming polyamides which enable efficient fiber-forming methods and systems that incorporate higher stain-resist reagent loadings in the fibers than heretofore possible.

SUMMARY OF THE INVENTION

The above and other objects are realized by the present invention, one embodiment of which relates to a method of forming an acid dye stain-resistant fiber or fibers comprising combining a masterbatch concentrate with a fiber-forming polyamide and a polymer and forming a fiber or fibers therefrom, the masterbatch concentrate comprising a reagent and a carrier therefor wherein the reagent has the formula:

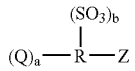

wherein: Q and Z are moieties which associate with free acid dye sites in the polyamide;

a is an integer from 0 to 2;

b is an integer from 1 to 4; and

R is selected from the group consisting of aliphatic, aromatic or alicyclic hydrocarbyl groups; and the carrier is selected from the group consisting of:

(A) a terpolymer comprising from about 56% to about 94.5% by weight of at least one alpha-monoolefin having 2 to 8 carbon atoms, about 5% to about 40% by weight of an ethylene-α,β unsaturated carboxylic acid (1) $C_1$–$C_4$ alkyl or (2) glycidyl ester and from about 0.5% to about 4.0% by weight of an internal anhydride of an ethylenically unsaturated carboxylic acid;

(B) a semi-crystalline thermoplastic polyester having a melting point of about 235° C. or less;

(C) a semi-crystalline thermoplastic polyamide with a melting point of about 235° C. or less; and (D) mixtures thereof;

and further wherein said polymer is selected from the group consisting of (A) and mixtures of (A) with at least one of (B) and (C) wherein the percentage by weight in said polymer of internal anhydride of an ethylenically unsaturated carboxylic acid is in the range of from about 0.5% to about 4.0%.

A further embodiment of the invention comprises an acid dye stain-resistant fiber-forming polyamide composition comprising a combination of a masterbatch concentrate, a fiber-forming polyamide and a polymer, the masterbatch concentrate comprising a reagent and a carrier therefor wherein the reagent has the formula:

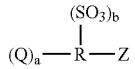

wherein: Q and Z are moieties which associate with free acid dye sites in the polyamide;

a is an integer from 0 to 2;

b is an integer from 1 to 4; and

R is selected from the group consisting of aliphatic, aromatic or alicyclic hydrocarbyl groups; and the carrier is selected from the group consisting of:

(A) a terpolymer comprising from about 56% to about 94.5% by weight of at least one alpha-monoolefin having 2 to 8 carbon atoms, about 5% to about 40% by weight of an ethylene-α,β unsaturated carboxylic acid (1) $C_1$–$C_4$ alkyl or (2) glycidyl ester and from about 0.5% to about 4.0% by weight of an internal anhydride of an ethylenically unsaturated carboxylic acid;

(B) a semi-crystalline thermoplastic polyester having a melting point of about 235° C. or less;

(C) a semi-crystalline thermoplastic polyamide with a melting point of about 235° C. or less; and (D) mixtures thereof;

and further wherein said polymer is selected from the group consisting of (A) and mixtures of (A) with at least one of (B) and (C) wherein the percentage by weight in said polymer of internal anhydride of an ethylenically unsaturated carboxylic acid is in the range of from about 0.5% to about 4.0%.

Another embodiment of the invention comprises a masterbatch concentrate for addition to a fiber-forming polyamide to form an acid dye stain-resistant fiber-forming polyamide, the concentrate comprising a reagent and a carrier therefor wherein the reagent has the formula:

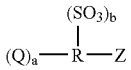

wherein: Q and Z are moieties which associate with free acid dye sites in the polyamide;

a is an integer from 0 to 2;

b is an integer from 1 to 4; and

R is selected from the group consisting of aliphatic, aromatic or alicyclic hydrocarbyl groups; and the carrier is selected from the group consisting of:

(A) a terpolymer comprising from about 56% to about 94.5% by weight of at least one alpha-monoolefin having 2 to 8 carbon atoms, about 5% to about 40% by weight of an ethylene-α,β unsaturated carboxylic acid (1) $C_1$–$C_4$ alkyl or (2) glycidyl ester and from about 0.5% to about 4.0% by weight of an internal anhydride of an ethylenically unsaturated carboxylic acid;

(B) a semi-crystalline thermoplastic polyester having a melting point of about 235° C. or less;

(C) a semi-crystalline thermoplastic polyamide with a melting point of about 235° C. or less; and (D) mixtures thereof.

Other embodiments of the invention relate to acid dye stain-resistant fibers formed utilizing the compositions and methods described above, as well as textile articles incorporating these fibers.

DETAILED DESCRIPTION OF THE INVENTION

The terms below have the following meanings herein, unless otherwise noted:

"Reagent" refers to any chemical compound, composition or material which associates (as that term is defined below) with the free acid dye sites in a fiber-forming polyamide to thereby render them unavailable for association with an acid dye, which reagent is incapable itself of associating with or taking up the acid dye.

"Association" refers to the chemical reaction or bonding between the reagent and the free acid dye sites in the polyamide which results in prevention of "taking up" of the acid dye by the polyamide, i.e., staining. The association may take the form of a chemical reaction or an acid-salt formulation. Additional types of association include hydrogen bonding, dipole-dipole interaction, Van der Waals forces and coordination complexing.

"Acid dye stain" refers to any material or composition which functions as an acid dyestuff by reacting with the free dye sites in polyamides to substantially permanently color or stain the latter.

The term "acid dye sites" refers to those basic sites in polyamides (e.g., amine end groups, amide linkages, etc.) which react or associate with acid dyes, thereby resulting in a stain bonded thereto.

"Disabling" the acid dye sites from taking up acid dye stains refers to the effect of the association between the reagent and the acid dye sites which renders the latter less capable of associating with acid dyes such as, for example, those in soft drinks, tomato-based products, etc., which result in staining.

The present invention is predicated on the discovery that optimum levels of resistance to acid dye stain may be imparted to polyamide fibers by compounding certain reagents with fiber-forming polyamide compositions subsequent to polymerization of the polyamide and prior to the formation of the fibers. The invention thereby enables avoidance of the above-enumerated disadvantages associated with coating the polyamide fibers with stain resistant SACs and with formation of the polyamides by copolymerizing sulfonate containing monomers.

The selection of a suitable non-acid dyeable reagent having at least one functional group capable of associating with the acid dye sites available in fiber-forming polyamides, thereby rendering those dye sites unavailable for association with acid dye stains, enables the formation of stain-resistant fibers having predetermined and optimum levels of stain resistance not obtainable by the methods and systems of the prior art.

Suitable such reagents include those having at least one functional moiety which preferentially associates with the active acid dye sites in the fiber-forming polyamide and, additionally, contains at least one sulfonyl group. The reagent, of course, should be otherwise substantially inert with respect to the fiber-forming properties of the polyamide.

Exemplary of such reagents are those having the formula:

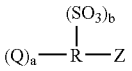

wherein: Q and Z are moieties which associate with the acid dye sites in the polyamide;

a is an integer from 0 to 2;

b is an integer from 1 to 4; and

R is aliphatic, aromatic or alicyclic and, preferably, hydrocarbyl.

The reagent is selected so as to preferentially associate with the amine end group and/or amide linkage acid dye sites in the polyamide. Preferably, a substantially colorless reagent is selected unless, of course, the reagent is expected to contribute a desired color to the fibers prepared from the polyamide.

The associative functional moieties, Q and Z, may comprise any chemistry that will associate with amine or amide linkages, providing that the functionality does not promote increased stain uptake or otherwise deleteriously impact on the ultimate polyamide composition or articles manufactured therefrom. Thus, Q and Z are preferably combined to form carboxylic anhydride groups or are, individually, carboxylic acid groups or alkali metal, alkaline earth metal or transition metal salts thereof; isocyanate groups; epoxy groups; ester groups and α,β-diketone groups. Thio functionalities are generally not employed due to their promotion of yellowing in fibers prepared from polyamide compositions containing them when subjected to light, heat, oxides of nitrogen, etc.

The backbone of the reagent or R may be any suitable aliphatic, aromatic, alicyclic or heterocyclic structure such as phenyl, naphthyl, alkyl (straight or branched chain), cycloalkyl including substituted cycloalkyls, aralkyl, alkenyl and cycloalkenyl.

Exemplary of such reagents are 5-sulfoisophthalic acid, 3-sulfobenzoic acid, 4-(acetoacetamido)benzene sulfonic acid, 4-isocyanatobenzene sulfonic acid, 4-(2,3-epoxypropyl)-benzene sulfonic acid, dimethyl-5-sulfoisophthalate, 3,5-di-(2,3-epoxypropyl)benzene sulfonic acid, 3,5-di-isocyanatobenzene sulfonic acid, 3,5-di-(acetoacetamido)benzene sulfonic acid, the sodium and lithium salts of all of the above, and sodium or lithium salt of sulfophthalic anhydride.

The invention is applicable to provide acid dye stain resistance in any fiber-forming polyamide such as PA-6, PA-66, PA-MXD6, PA-11, PA-12, PA-69, PA-610, PA-612 and amorphous polyamides such as PA-3M6T (the copolymer of terephthalic acid and trimethylhexamethylene diamine) and PA-6I (a copolymer of hexamethylene diamine and isophthalic acid).

The carrier polymer preferably comprises a terpolymer of ethylene or mixtures of ethylene with higher α-olefins as discussed above; an acrylic, methacrylic acid or glycidyl ester; and maleic anhydride. The ester is most preferably ethyl or butyl acrylate or glycidyl methacrylate. The ratios of the three monomers in the terpolymers may be in the following ranges:

| Terpolymer | Range of % by weight | Most Preferred Range of % by weight |
|---|---|---|
| α-olefin | 56–94.5 | 70–92 |
| ester | 5–40 | 7.5–25 |
| anhydride | 0.5–4 | 2.5–3.5 |

The polyester (B) may be any semi-crystalline thermoplastic polyester provided that it has a melting point of about 235° C. or less and is compatible with and has no deleterious effects on the remainder of the components in the composition. Exemplary of such copolyesters are poly(butylene terephthalate), poly(trimethylene terephthalate), poly(ethylene terephthalate-co-isophthalate) comprising 60–97 mol % of terephthalate units and 3–40 mol % of isophthalate units.

The preferred polyamide is PA-11 or PA-12.

The above-described terpolymers, copolyesters and polyamides are available commercially or may be prepared utilizing methods well known to those skilled in the art.

The carrier polymer employed in the masterbatch concentrate may be the same as or different than the polymer employed in the fiber-forming combination.

Where the carrier polymer comprises a terpolymer described above, it presumably does not react with the reagent in the masterbatch concentrate. It is theorized, but unproven, that when the concentrate is incorporated with the fiber-forming polyamide, at least the anhydride portion of the terpolymer reacts with at least some of the free amino groups in the polyamide. The polymer employed in the fiber-forming combination is also presumed to react similarly. Where the carrier polymer comprises a polyester or polyamide described above, a reaction may occur between the reagent and the carrier polymer, as indicated by an exothermic condition observed during the method of Example 1 during the venting of the twin-screw extruder during preparation of the concentrate.

The composition may include any of the conventional adjuvants for enhancing the formation of fibers from the polyamide composition such as anti-oxidants, stabilizers, colorants, processing aids, anti-static agents, flame retardants, fillers, nucleating agents, anti-microbials, melt viscosity enhancers (e.g., catalysts which encourage further polymerization of the polyamide or additives which function to form linkages between polyamide chain ends) or mixtures thereof. Catalysts and/or reducing agents can be added to enhance the association of the reagent with the fiber-forming polyamide. Examples of suitable catalysts/reducing agents include salts of hypophosphites such as sodium hypophosphite, ammonium hypophosphite and manganese hypophosphite, or other phosphorus-containing organic compounds such as phenylphosphinic acid, polyphosphoric acids and triphenyl phosphite.

A preferred embodiment of the invention relates to the preparation of a masterbatch concentrate of carrier and reagent which can be blended with a suitable fiber-forming polyamide prior to or at the melt-spinning stage to achieve the desired level of stain resistance.

Employing the carrier materials disclosed herein enables up to about 80% weight loadings of the stain-resist reagent in the masterbatch concentrates without a significant drop in melt viscosities and without color deterioration. When employing the preferred polyamide carrier disclosed in copending application Ser. No. 08/522,123, weight loadings up to only about 20% are possible. The increased loadings enabled by the present invention result in highly advantageous economic savings, including, but not limited to, energy and labor costs, as well as the ability to employ smaller feeders in the dilution system for incorporation of the concentrate into the polyamide spinning resin.

The masterbatch concentrate may be prepared according to methods such as those described in copending application Ser. No. 08/522,123 employing levels of reagent up to about 80% by weight based on the weight of the concentrate; preferably from about 25% to about 60%.

The stain-resist reagent may be combined with the carrier polymer(s) in any suitable form, e.g., powders, pellets, granules. The carrier polymer(s) is may be employed as powders, granules or pellets. The stain-resist reagent is preferably combined with the carrier polymer(s) employing a melt extruder and, most preferably, a screw-type extruder. Optimally, a twin-screw extruder of the fully intermeshing type with both screws rotating in the same direction (co-rotating) is employed, although other types of twin-screw extruders may be used such as counter-rotating and/or non-intermeshing types single screw extruders may also be successfully employed. The extruder preferably has a barrel length to screw diameter ratio of between about 24:1 and about 30:1; however, it will be understood that any suitable ratio may be employed depending upon the parameters of the particular compounding process contemplated.

The melt emerging from the die of the compounding extruder is stranded through a water bath to solidify the melt, followed by air drying of the strand to remove the bulk of the surface water, and pelletization. The concentrate pellets formed are then dried prior to fiber melt spinning to a moisture level of less than 3,000 ppm and preferably less than 500 ppm. This drying of the concentrate is preferably accomplished in an inert gas atmosphere. The concentrate is then mixed on the fiber melt spinning line with non-stain resistant polyamide resin feedstock, dried to a moisture level of less than 3,000 ppm and preferably less than 500 ppm, the desired ratio depending on the level of stain resistance required in the fiber product. The fiber melt spinning process of a conventional type is used, familiar to those skilled in the art. Generally, the fibers are produced in non-vented extruder barrels, although vented extruders may also be used. Other additives such as colorants and stabilizers may be added during the fiber formation process.

The compositions are prepared by combining the concentrate, polyamide(s), polymer and, optionally, adjuvant(s) under conditions which ensure association between the functional moieties of the reagent and the free acid dye sites in the polyamide(s). Preferably, the polyamide(s), concentrate and polymer are combined by melt blending at temperatures above the melting point of the polyamide(s), but below the decomposition temperature of the polymer. They may be combined in a pre-fiber spinning compounding operation or directly (i.e., on-line) in the fiber melt spinning stage. Product fibers made according to the invention show durable stain-resistant properties equivalent or superior to those produced according to the prior art methods without the consequent disadvantages attendant thereto.

The amounts and ratios of fiber-forming polyamide, concentrate and polymer may be varied according to desired needs. Generally, it is preferred to employ combinations containing a weight of concentrate that contains between about 1,500 ppm to about 3,000 ppm of sulfur, an amount of polymer such that the combination contains between about 0.01% to about 0.6% of the internal anhydride of an ethylenically unsaturated carboxylic acid and the remainder, polyamide.

While it is in no way intended to limit the invention by the soundness or accuracy of any theory set forth to explain the nature of the invention, it is postulated that, during the processing step(s), the stain-resistant reagent at least partially associates with, or reacts with, reactive chemical groups or acid dye sites on the polyamide and the carrier polymer(s) depending on the chemistry thereof, such as carboxyl end groups, ester linkages, amine end groups or amide linkages. Removal of volatiles from the compounding mixture aids this association and/or reaction with the polyamide and the carrier polymer(s). This removal of volatiles is achieved preferably by the presence of one or more vents on the extruder barrel, although venting is not a requirement for the process of the invention. When a single vent is used with an extruder of a length to diameter ratio of 24 to 1, the vent port is suitably located approximately 19 screw diameters down the length of the barrel. The optimum position of the vent port is determined by the extruder screw profile used. The extraction of volatiles through the vent port is preferably vacuum assisted with a vacuum level of greater than 10 in. Hg and preferably greater than 20 in. Hg. The rate of devolatilization can be assisted through substantially dry nitrogen gas injection through an inlet port located either upstream or downstream of the vent port. Under this situation, a lower vacuum level may be acceptable. Additional ways of promoting the association and/or reaction with the polyamide and carrier polymer(s) are through controlled drying of the feedstocks, addition of water-scavenging additives, or a combination of these methods.

The concentrate, polymer and polyamide resin are preferably fed to the fiber-spinning extruder in a pre-dried form with a controlled moisture level to promote the association and/or reaction of the stain-resist reagent with the polyamide and carrier polymer(s). The moisture levels of both the additives and the resin are less than 5,000 ppm and are preferably less than 1,000 ppm. When drying both of these materials, an inert gas drying atmosphere is preferred. The additives and the resin may be either fed to the extruder as a blend of the two materials using a single feed hopper or by using separate feed hoppers of a suitable type such as gravi-metric or volumetric feeders. Additives to enhance the relative viscosity (RV) of the concentrate can also be added at this stage. When a blend of the materials is used, a double cone tumbler blender is preferred for preparation of the blend, although other types of blenders may be used.

The extruder temperature profiles used and the desired melt temperature during the mixing process will depend, as noted above, principally on the polyamide type and grade chosen. For example, when PA-6 is utilized, the melt temperature preferred is between 240° C. and 260° C. and for PA-66 the preferred melt temperature range is between 265° C. and 285° C. The optimum melt temperatures for these two resin types will depend on the grade employed.

The polyamide resin should have a relative solution viscosity of equal to or greater than 2.4, preferably equal to or greater than 2.7, and most preferably between 3.0 and 3.3. The polyamide is typically produced by melt polymerization, although other methods known to those skilled in the art such as, e.g., solution polymerization, may be employed. The desired RV may be achieved wholly through melt polymerization or a two-step process may be employed, i.e., melt polymerization to an RV value lower than that desired, followed by the solid state polymerization to the desired value. The relative viscosity of the resin is determined by first preparing 0.55% w/w solutions of the pre-dried polyamide in concentrated sulfuric acid (analytical grade, 96±0.5%). Solution flow times are determined in a Cannon-Ubbelhode size 2 viscometer suspended in a viscometer water bath controlled at 25° C.±0.02° C. The flow times of the sulfuric acid are also measured. The relative viscosity is calculated by dividing the flow time of sample solution by the flow time of the solvent. The polyamide resin should also have an amine end group (AEG) level of less than 60 equivalents per $10^6$ g and preferably less than 40 equivalents per $10^6$ g. The AEG level is determined by means of a potentiometric titration. A known weight of sample is dissolved in m-cresol and titrated against 0.1 M perchloric acid in methanol. A blank titration is also carried out on the m-cresol and used to correct the sample titre.

If the following examples, a standard test is used to evaluate the stamen resistance of the yarn formed. It involves the use of an acidified solution of FD&C Red 40 dye which is present in the soft drink cherry-flavored Kool-Aid commercially sold by Kraft General Foods, Inc.

Typically, 0.1000 g±0.0030 g of FD&C Red 40 dye (CI Food Red 17) is dissolved in 1,000 $cm^3$ of distilled water. The pH of the dye solution is adjusted to between 2.80 and 2.90 by making small additions of citric acid of technical grade or better. The pH adjusted solution is allowed to reach room temperature, i.e., 21° C.±1° C., prior to use.

1.0000±0.0010 g of yarn is placed in 50 $cm^3$ of the Red 40 solution in a 100 $cm^3$ glass beaker and the yarn is briefly stirred in the solution to ensure that it is fully wetted by the solution. The beaker is allowed to stand for 60 minutes without any further agitation.

The yarn is washed for 120 seconds under free-flowing hot tap water that is at a temperature of 40–50° C. The yarn is then dried by initially blotting with a clean white paper towel to remove the bulk of the surface moisture, followed by allowing it to sit at room temperature for at least 16 hours.

The stain resistance of the yarn is determined by visual comparison to the AATCC Red 40 Stain Scale, which is available from the American Association of Textile Chemists and Colorists (AATCC), Research Triangle Park, N.C. The scale consists of ten film squares colored with gradually increasing strengths of FD&C Red 40 numbered from 1 to 10, with 1 being the strongest color and 10 being colorless. The unstained yarn is placed underneath the colored portions of the scale and the stained yarn is placed underneath the colorless portion of the scale and viewed under daylight or equivalent illuminant. The light should be incident upon the surfaces at an angle of 45°±5° and the viewing direction should be 90°±5° to the plane of the surfaces. The stained yarn is compared to the unstained yarn placed under the closest numbered colored square of the stain scale so that the best color match is obtained. If the color of the stained yarn falls between two squares on the scale, then half grades are used. The number of this colored square, or squares if the match falls between two squares, is called the Stain Rating.

The invention is illustrated by the following non-limiting examples. All percentages expressed herein are by weight unless otherwise indicated.

EXAMPLE 1

A stain resist masterbatch was prepared using 5-sodiosulfoisophthalic acid and a copolyester supplied under the tradename Selar PT 8307 by E.I. duPont de Nemours and Company, with an IV=0.71 and a melting point of 221° C. A Berstorff ZE40A co-rotating twin-screw extruder with an L:D=30:1 consisting of seven electrically heated barrel sections and a hot water feed zone was used to produce the masterbatch containing a 50% level of 5-sodiosulfoisophthalic acid with a low intensity mixing screw profile known to those skilled in the art. Barrel temperatures were set to give a melt temperature of 237° C. with a screw speed of 248 rpm. Two vacuum vents were sited down the extruder barrel on heated barrel sections 2 and 6. A vacuum of 26.5 in. Hg was pulled on both of these vents using a water ring vacuum pump. The moisture level of the 5-sodiosulfoisophthalic acid before compounding was less than 1,000 ppm and the moisture level of the Selar PT 8307 before compounding was 79 ppm. An extruder throughput of 150 lbs./hour was used. A white-colored masterbatch pellet was produced. 4% of this masterbatch pellet was tumble-blended with 96% by weight of PA-66 pellet until thoroughly blended. The PA-66 used had been melt polymerized from a salt of adipic acid and hexamethylenediamine to an RV=2.65, followed by solid state polymerization to an RV=3.1. The masterbatch pellet was dried to a moisture level of 135 ppm before incorporation into the blend. The PA-66 had a moisture level of 302 ppm. The pellet blend was melt spun on a 2-inch diameter single screw extruder with an L:D=24:1. The screw had a mixing device at the end of the screw known to those skilled in the art. The output of the extruder fed a 136 round hole spinning pack containing filters to produce a 4600/136R undrawn yarn. The undrawn yarn was subsequently drawn on a yarn drawing machine at a draw ratio of 3.6:1 with heated feed and draw rolls. The drawn yarn was conditioned at 70° F. and 50% relative humidity for 24 hours before staining according to the standard stain test described above. A stain rating of 7 was obtained.

EXAMPLE 2

4% of the stain resist masterbatch prepared as described in Example 1 was tumble-blended with 84.6% of the same PA-66 pellet resin as described in Example 1 and 9.6% of a terpolymer resin pellet of ethylene, ethyl acrylate and maleic anhydride polymerized in the ratios of 79.65%, 17.5% and 2.85%, respectively (supplied by Elf Atochem under the tradename and grade identification Lotader 7500). The moisture levels of the stain resist masterbatch and the PA-66 resin were as described in Example 1. The pellet blend was melt spun and drawn also as described in Example 1. The drawn yarn was stained according to the standard stain test described above. A stain rating of 8.5 was obtained.

EXAMPLE 3

A stain resist masterbatch with 5-sodiosulfoisophthalic acid and a heat and light stabilized general purpose extrusion grade PA-12 terpolymer, supplied by Elf Atochem under the tradename and grade identification Rilsan AESNO TL, was prepared with a similar process to Example 1, except a melt temperature of 196° C. was used. The level of 5-sodiosulfoisophthalic acid in the masterbatch was 50% by weight. The moisture levels of the 5-sodiosulfoisophthalic acid before compounding were less than 1,000 ppm and 150 ppm, respectively. A white-colored masterbatch was produced. 4% of the stain resist masterbatch was tumble-blended with 96% of the same PA-66 pellet resin, melt spun and drawn as described in Example 1. The drawn yarn was stained according to the standard stain test described above. A stain rating of 7 was obtained.

EXAMPLE 4

4% of the stain resist masterbatch prepared as described in Example 3 was tumble-blended with 84.6% of the same PA-66 pellet resin as described in Example 1 and 9.6% of Lotader 7500. The moisture levels of the stain resist masterbatch and the PA-66 resin were as described in Example 1. The pellet blend was melt spun and drawn also as described in Example 1. The drawn yarn was stained according to the standard stain test described above. A stain rating of 9 was obtained.

EXAMPLE 5

A sulfonated PA-66 resin, polymerized from adipic acid, 5-sodiosulfoisophthalic acid and hexamethylene diamine, containing a sulfur level of 2,300 ppm and with an RV=2.7, with a moisture level of 647 ppm, was melt spun and drawn as described in Example 1. The drawn yarn was stained according to the standard stain test described above. A stain rating of 8 was obtained.

EXAMPLE 6

A stain resist masterbatch was prepared from 5-sodiosulfoisophthalic acid and Lotader 7500 with a 50% level of the 5-sodiosulfoisophthalic acid in the masterbatch. A Leistritz ZSE-50 twin-screw extruder (50 mm screw diameter) in counter-rotating mode was used with a high intensity mixing screw profile known to those skilled in the art. The L:D was 36:1. The extruder barrel temperature profile was set to give a melt temperature of 185° C. and a screw speed of 180 rpm was used. Two extruder vents were used on electrically heated barrel zones 4 and 6; the vacuum level on the vent on zone 4 was −500 mbar and on zone 6 was −700 mbar. The extruder throughput was 150 lbs./hour. The moisture levels of the 5-sodiosulfoisophthalic acid and Lotader 7500 before compounding were less than 1,000 ppm and 250 ppm, respectively. A white-colored masterbatch was produced. 4% of the stain resist masterbatch was tumble-blended with 96% of the same PA-66 pellet resin, melt spun and drawn as described in Example 1, except a trilobal-shaped hole die was used and process conditions set to give a 600/30Y drawn yarn. The drawn yarn was stained according to the standard stain test described above. A stain rating of 9 was obtained.

EXAMPLE 7

4% of the stain resist masterbatch prepared as described in Example 3 was tumble-blended with 86.4% of the same PA-66 pellet resin as described in Example 1 and 9.6% of Lotader 7500. The moisture levels of the stain resist masterbatch and the PA-66 resin were as described in Example 1. The pellet blend was melt spun and drawn also as described in Example 6. The drawn yarn was stained according to the standard stain test described above. A stain rating of 9.5 was obtained.

EXAMPLE 8

4% of the stain resist masterbatch prepared as described in Example 1 was tumble-blended with 86% of a PA-66 resin polymerized from adipic acid and hexamethylene diamine with an RV=2.6, and 10% of Lotader 7500 until thoroughly blended. The pellet blend was melt spun and drawn as described in Example 1. The drawn yarn was stained according to the standard stain test described above. A stain rating of 6.5 was obtained.

EXAMPLE 9

2% of the stain resist masterbatch prepared as described in Example 1 was tumble-blended with 88% of a PA-66 resin polymerized from adipic acid and hexamethylene diamine with an RV=2.6, and 10% of Lotader 7500 until thoroughly blended. The pellet blend was melt spun and drawn as described in Example 1. The drawn yarn was stained according to the standard stain test described above. A stain rating of 5.5 was obtained.

EXAMPLE 10

4% of the stain resist masterbatch prepared as described in Example 1 was tumble-blended with 91% of a PA-66 resin polymerized from adipic acid and hexamethylene diamine with an RV=2.6, and 5% of Lotader 7500 until thoroughly blended. The pellet blend was melt spun and drawn as described in Example 1. The drawn yarn was stained according to the standard stain test described above. A stain rating of 8.5 was obtained.

EXAMPLE 11

A stain resist masterbatch was prepared containing 50% of dimethyl-5-sodiosulfoisophthalate in Selar PT 8307 using the same twin-screw extruder set up as described in Example 1. Barrel temperatures were set to give a melt temperature of 226° C. with a screw speed of 324 rpm. Two vacuum vents were sited down the extruder barrel on heated barrel sections 2 and 6. A vacuum of 26.5 in. Hg was pulled on both of these vents using a water ring vacuum pump. The moisture level of the dimethyl-5-sodiosulfoisophthalate before compounding was less than 1,000 ppm and the moisture level of the Selar PT 8307 before compounding was 79 ppm. An extruder throughput of 75 lbs./hour was used. A white-colored masterbatch pellet was produced. 4% of this masterbatch pellet was tumble-blended with 96% by weight of the PA-66 pellet of Example 1. The masterbatch pellet was dried to a moisture level of 57 ppm before incorporation into the blend. PA-66 had a moisture level of 146 ppm. The pellet blend was melt spun on the same extruder as described in Example 1, but with a trilobal spinning pack with 30 trilobal-shaped holes containing filters to produce a 3700/60Y undrawn yarn. The undrawn yarn was subsequently drawn on a yarn drawing machine at a draw ratio of 3.6:1 with heated feed and draw rolls as per Example 1. The drawn yarn was conditioned at 70° F. and 50% relative humidity for 24 hours before staining with an acidified solution of FD&C Red 40. A stain rating of 6.5 was obtained.

EXAMPLE 12

4% of the stain resist masterbatch prepared as described in Example 11 was tumble-blended with 86% of the PA-66 pellet described in Example 1, and 10% of Lotader 7500 until thoroughly blended. The pellet blend was melt spun and drawn as described in Example 11. The drawn yarn was stained according to the standard stain test described above. A stain rating of 6.5 was obtained.

The feed yarn for manufacture of synthetic textiles and carpets normally takes one of two forms: staple or continuous filament. Staple yarn is produced by spinning an undrawn yarn tow (a large bundle of filaments), that is drawn, mechanically crimped (textured), heat-set and cut into set lengths. The cut yarn is then carded followed by drafting to give a continuous staple yarn. Continuous filament yarn is spun and textured either as a single process or as a multi-step process. The filament bundle size for continuous filament yarn is often considerably smaller than that used for staple tow. The melt spinning portion for both staple and continuous filament yarn types is similar, i.e., molten resin with any desired adjuvants is compounded and fed by a screw extruder or other suitable melting device to a gear pump that forces the melt in a controlled and uniform manner through a melt filtration system and the fine capillaries in a spinneret, followed by air cooling to driven rolls to carry the fibers away from the face of the spinneret. The melting device used should be designed such that satisfactory mixing is achieved to present a substantially uniform melt to the gear pump/spinneret. The actual design will depend on the resin type and grade used and the nature of any adjuvants used. The cross-section of the capillaries in the spinneret is specifically designed for the fiber end use application and will influence the cross-section shape of the spun fiber. Typical shapes are round, deltoid and trilobal. Various types of texturing processes exist for crimping continuous filament including a stuffer-box, air-jet and false-twist texturing. Drawing of the yarn is typically a precursor of the texturing process.

There are typically three types of methods for forming fibers into apparel, textiles and carpets: (1) weaving, (2) knitting, including warp and circular types, and (3) non-woven techniques, including tufting. Woven fabrics consist of sets of yarns interlaced at right angles in established sequences on a loom. Knitting consists of forming loops of yarn with the aid of thin, pointed needles or shafts. As new loops are formed, they are drawn through those previously shaped. This interlooping and the continued formation of new loops produce knit fabrics. Non-woven fabrics consist of a web of staple or filament fibers held together either by application of a bonding or adhesive agent or by the fusing of fibers by application of heat. Tufting consists of inserting loops into an already formed backing fabric. The backing fabric may be of any type and composed of any fiber, including both natural and synthetic fibers such as jute and polypropylene. The yarn loops are inserted into the backing with needles. The loops can be cut or left uncut. They are held in place either by applying a special coating or by untwisting the tufted yarn and shrinking the backing fabric.

Fibers of the present invention may be combined into yarn according to methods and systems well known to those skilled in the art. Either the fibers or yarns prepared therefrom may be manufactured into novel textiles, carpets and other articles of manufacture requiring polyamides having enhanced resistance to staining by acid dyestuffs according to conventional, well known methods.

I claim:

1. A method of forming an acid dye stain resistant fiber or fibers comprising combining a masterbatch concentrate with a fiber-forming polyamide and a polymer and forming a fiber or fibers therefrom, said masterbatch concentrate comprising a reagent and a carrier therefor wherein said reagent has the formula:

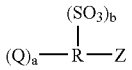

wherein:

Q and Z are moieties which associate with free acid dye sites in said polyamide;

a is an integer from 0 to 2;

b is an integer from 1 to 4; and

R is selected from the group consisting of aliphatic, aromatic or alicyclic hydrocarbyl groups;

and said carrier is selected from the group consisting of:

(A) a terpolymer comprising from about 56% to about 94.5% by weight of at least one alpha-monoolefin having 2 to 8 carbon atoms, about 5% to about 40% by weight of an ethylene-α, β unsaturated carboxylic acid (1) $C_1$ $C_4$ alkyl or (2) glycidyl ester and from about 0.5% to about 4.0% by weight of an internal anhydride of an ethylenically unsaturated carboxylic acid;

(B) a semi-crystalline thermoplastic polyester having a melting point of about 235° C. or less;

(C) a semi-crystalline thermoplastic polyamide with a melting point of about 235° C. or less; and (D) mixtures thereof;

and further wherein said polymer is selected from the group consisting of (A) and mixtures of (A) with at least one of (B) and (C) wherein the percentage by weight in said polymer of internal anhydride of an ethylenically unsaturated carboxylic acid is in the range of from about 0.5% to about 4.0%.

2. The method of claim 1 comprising melt-spinning said combination of masterbatch concentrate, fiber-forming polyamide and polymer.

3. The method of claim 2 comprising combining said masterbatch concentrate, said fiber-forming polyamide and said polymer on-line in said melt-spinning process.

4. The method of claim 1 wherein said masterbatch concentrate comprises from about 20° to about 80% by weight of said reagent.

5. The method of claim 1 wherein said combination contains an amount of said masterbatch concentrate that contains between about 1,500 ppm and about 3,000 ppm of sulfur; an amount of said polymer such that the combination contains between about 0.01% to about 0.6% of the internal anhydride; and the remainder is said polyamide.

6. The method of claim 5 wherein at least one of said Q and Z is a carboxylic acid group or a salt thereof.

7. The method of claim 5 wherein at least one of said Q and Z is an isocyanate group.

8. The method of claim 5 wherein at least two of said Q and Z combine to form a carboxylic acid anhydride.

9. The method of claim 5 wherein said reagent is 5-sulfoisophthalic acid or a salt thereof.

10. The method of claim 9 wherein said reagent is selected from the group consisting of an alkali metal, alkaline earth metal and transition metal salt of 5-sulfoisophthalic acid.

11. The method of claim 10 wherein said reagent is the lithium salt of 5-sulfoisophthalic acid.

12. The method of claim 10 wherein said reagent is the sodium salt of 5-sulfoisophthalic acid.

13. The method of claim 9 wherein said reagent is 3-sulfobenzoic acid or the sodium or lithium salt thereof.

14. The method of claim 1 wherein, in (A), said alpha-monoolefin is ethylene.

15. The method of claim 1 wherein, in (A), said ethylene-$\alpha,\beta$ unsaturated acid is selected from the group consisting of acrylic acid, methacrylic acid or mixtures thereof.

16. The method of claim 1 wherein, in (A), said internal anhydride of an ethylenically unsaturated acid is maleic anhydride.

17. The method of claim 1 wherein, in (B), said alpha-monoolefin is ethylene.

18. The method of claim 1 wherein said carrier and said polymer may be the same or different.

19. The method of claim 1 wherein said fiber-forming polyamide is PA-6.

20. The method of claim 1 wherein said fiber-forming polyamide is PA-66.

21. The method of claim 1 wherein said fiber-forming polyamide is PA-MXD6.

22. The method of claim 1 wherein said fiber-forming polyamide is PA-11.

23. The method of claim 1 wherein said fiber-forming polyamide is PA-12.

24. The method of claim 1 wherein said fiber-forming polyamide is PA-69.

25. The method of claim 1 wherein said fiber-forming polyamide is PA-610.

26. The method of claim 1 wherein said fiber-forming polyamide is PA-612.

27. The method of claim 1 wherein said fiber-forming polyamide is an amorphous polyamide.

28. The method of claim 27 wherein said fiber-forming amorphous polyamide is a copolymer of terephthalic acid and trimethylhexamethylene diamine.

29. The method of claim 1 wherein said combination additionally contains a fiber-forming adjuvant.

30. The method of claim 29 wherein said fiber forming adjuvant is selected from the group consisting of an anti-oxidant, stabilizer, colorant, processing aid, catalyst, filler, nucleating agent, anti-microbial, melt viscosity enhancer or mixtures thereof.

* * * * *